United States Patent [19]

Champagne

[11] Patent Number: 5,014,598

[45] Date of Patent: May 14, 1991

[54] FLUID PRESSURE ACTUATOR

[75] Inventor: Raymond P. Champagne, Coventry, R.I.

[73] Assignee: Neles-Jamesbury Corporation, Worcester, Mass.

[21] Appl. No.: 292,425

[22] Filed: Dec. 30, 1988

[51] Int. Cl.[5] ..... F01B 31/14; F15B 15/24

[52] U.S. Cl. ..... 92/13.005; 92/13.6; 92/136; 92/13

[58] Field of Search ..... 92/13.5, 13.6, 13.8, 92/136, 13

[56] References Cited

U.S. PATENT DOCUMENTS

| | | | |
|---|---|---|---|
| 939,656 | 11/1909 | Bassett | 92/13.6 |
| 3,130,646 | 4/1964 | Pennington | 92/13.6 |
| 3,921,504 | 11/1975 | Mumford et al. | 92/13.6 |
| 4,023,468 | 5/1977 | Poirier | 92/13.6 |
| 4,469,014 | 9/1984 | Nelson | 92/13.6 |

*Primary Examiner*—John T. Kwon
*Assistant Examiner*—Thomas Denion
*Attorney, Agent, or Firm*—Oblon, Spivak, McClelland, Maier & Neustadt

[57] ABSTRACT

A fluid pressure actuator having two connected pistons movable in a cylinder, and having a gear rack associated therewith to engage a pinion attached to the shaft to be rotated. Adjustable travel stops are located on each end of the cylinder to control the position of the actuator at the end of the stroke. Each stop has a pair of stop plates which have ramps on the mating faces such that rotation of one stop plate relative to the other adjusts the thickness of the pair, thereby adjusting the position of the end stop for the piston.

3 Claims, 3 Drawing Sheets

FLUID PRESSURE ACTUATOR

BACKGROUND OF THE INVENTION

1. Field of the Invention

The present invention relates to fluid pressure actuators for rotating a shaft back and forth such as rotating a valve shaft between an open and closed position.

2. Description of the Background

Fluid pressure actuators are old and well known in the art of rotating a shaft such as a valve shaft. These fluid pressure actuators comprise a cylinder in which is located a piston or pistons which are moved back and forth within the cylinder by means of fluid pressure which may be either pneumatic or hydraulic. The piston(s) has a rack associated therewith which engages a pinion attached to the shaft to be rotated and the translation of the piston(s) in the cylinder causes the rack to translate and the pinion to rotate.

In such fluid actuators, it is desirable to provide means for adjusting the stroke of the piston(s) to thereby adjust the rotation of the shaft. This is conventionally accomplished by means of adjusting screws through the end walls of the cylinder, with these adjusting screws engaging piston(s) at the end of the stroke. (See, for example, U.S. Pat. No. 4,566,670.) The problem with such adjusting screws is that they create concentrated loads and localized stresses. This requires the use of high strength materials and/or thick cross sections for the cylinder end caps.

SUMMARY OF THE INVENTION

The present invention involves an adjustable travel stop for a fluid actuator to control the position of the actuator at the end of the stroke such that the loads are distributed over the entire cylinder end cap. This allows the use of lower strength materials and results in component weight reduction. It also allows the use of materials which are somewhat more flexible and/or have lower creep resistance. Pairs of stop plates are used which are ramped on the mating faces such that rotation of one of the plates of the pair changes and adjusts the thickness of the pair, thereby adjusting the position of the end stop for the piston(s).

DESCRIPTION OF THE PREFERRED EMBODIMENTS

Figure 1:
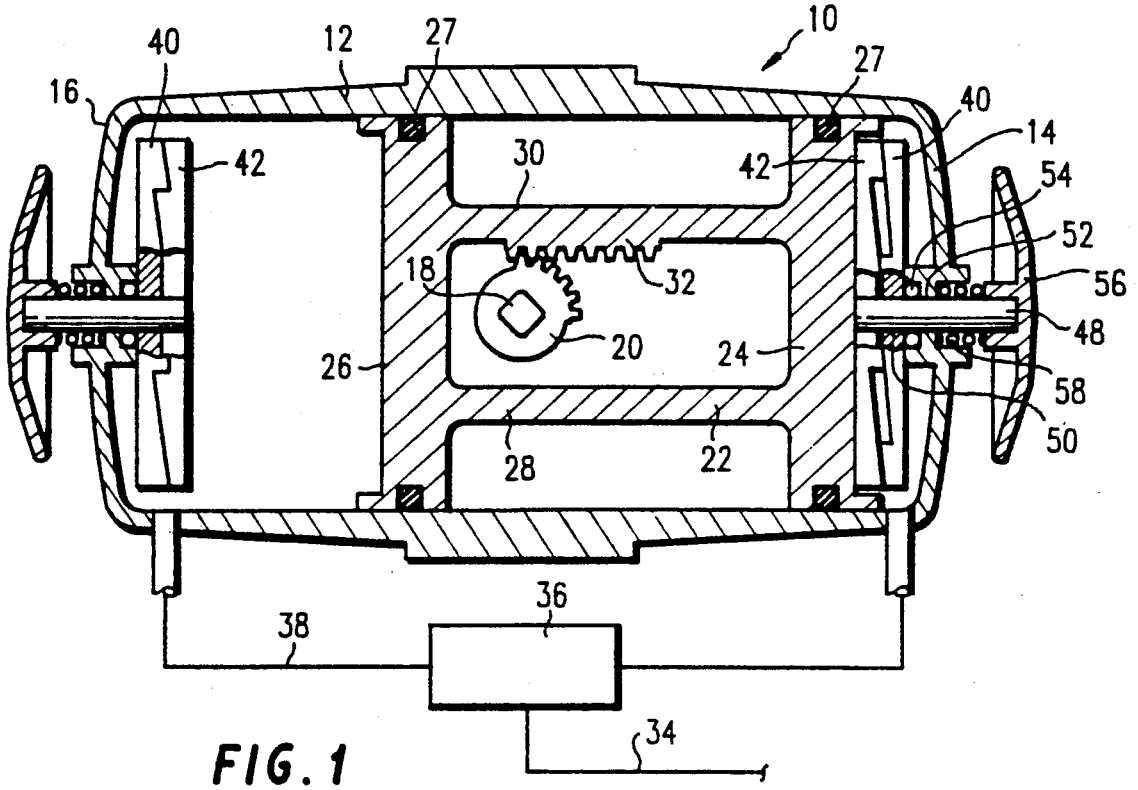
FIG. 1 is a cross section view of an actuator illustrating one embodiment of the invention.

Referring first to FIG. 1, the actuator comprises a fluid cylinder 10 which includes a cylinder body 12 and end caps 14 and 16 attached to the cylinder body 12. A shaft 18 (such as a valve shaft) extends into the center of the actuator cylinder 10 and a pinion gear 20 is attached thereto.

Located in the cylinder 10 is a piston assembly 22 which comprises two pistons 24 and 26 which are attached to each other by means of the connectors 28 and 30 whereby the pistons 24 and 26 of the piston assembly 22 move as one unit. The pistons 24 and 26 are sealed within the cylinder 10 by means of the O-rings 27 or other suitable piston seals.

Formed on (or attached to) the connector 30 is a rack gear 32 which engages the pinion gear 20. Therefore, translation of the piston assembly 22 upon application of fluid pressure causes rotation of the pinion gear 20 and the shaft 18.

It can be seen that the degree of rotation of the pinion gear 20 and the shaft 18 depends on the length of travel of the rack 32 and thus the piston assembly 22. When fluid pressure is introduced into the lefthand end of the cylinder 10 by means of the pressure line 34, the controller 36 and the pressure line 38, the piston assembly 22 is forced to the right into the position shown in FIG. 1. The length of travel of the piston assembly 22 is determined by the engagement of the piston 24 with the end stop at the right side of the actuator. Likewise, travel in the other direction is determined by the engagement of the piston 26 with the end stop at the left side of the actuator. It can thus be seen that the degree of rotation or total angular stroke of the pinion gear 20 and the shaft 18 is dependent on the distance between the end stops and that the stopping point of the rotation is dependent on the position of each end stop.

Figure 4:
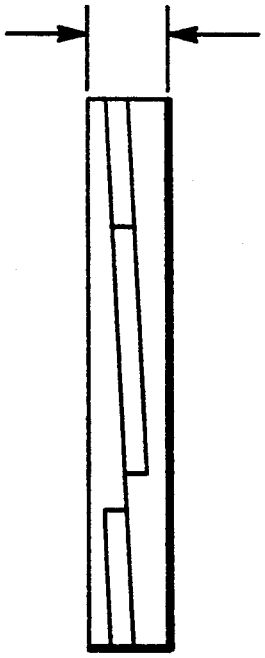
FIGS. 4 and 5 illustrate the stop plates of the present invention in different positions.
Figure 5:
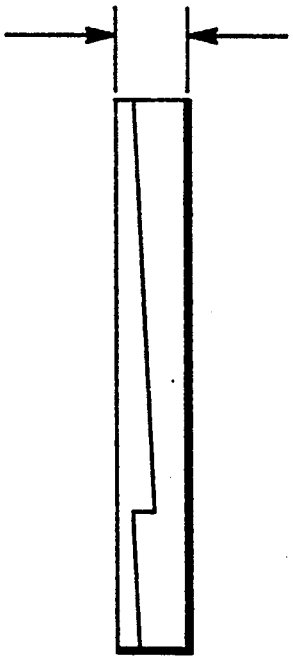

Referring now to the end stops of the present invention, each end stop comprises a pair of stop plates 40 and 42 as shown in FIG. 1. Each stop plate has one face 44 which is flat and perpendicular to the axis of the plate, with the other face 46 being ramped. Preferably, there are at least three ramps on each plate for stability. To form each end stop, two stop plates are paired with their ramped faces 46 abutting. Therefore, as one of the stop plates of the pair is rotated about its axis with respect to the other stop plate of the pair, the relative positions of the abutting ramps determine the thickness of the end stop. Changing the thickness of the end stop will change the point at which the piston assembly 22 engages and stops against the end stop. This difference in thickness can be seen in FIG. 4 which illustrates the two stop plates in a rotated position to give near maximum thickness while FIG. 5 illustrates the two plates rotated so as to give a minimum thickness.

Referring again to FIG. 1, the stop plates 42 are each attached to a shaft 48 by any suitable means such as welding, keying, splining, etc. The shafts 48 pass through apertures 50 substantially centrally positioned in the plates 40 and then through the apertures 52 in the end caps 14 and 16. The O-rings 54 provide seals between the shafts 48 and the end caps. Attached to the outer ends of the shafts 48 are handles 56 for purposes of rotating the shafts 48. The springs 58 force the handles 56 and shafts 48 outwardly so as to thereby maintain the plates 42 tightly against the plates 40. Rotation of the handles 56 and shafts 48 result in the rotation of the plates 42 with respect to the plates 40 since the plates 40 are fixed with respect to the end caps. The plates 40 may be attached by any suitable means to the end caps 14 and 16 or they may actually be formed as an integral part of the end caps.

Figure 2:
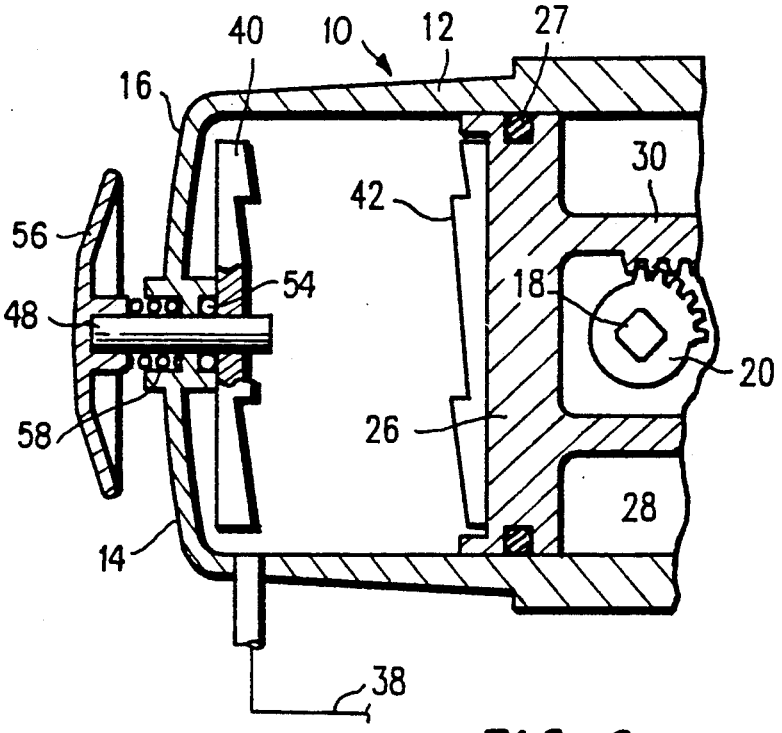
FIG. 2 is a cross section view of an actuator illustrating another embodiment of the invention.

As an alternative, the plates 42 may be the fixed plates attached to or formed as a part of the pistons 24 and 26. This arrangement is illustrated in FIG. 2 in which the plates 40 are now attached to the shafts 48 and are rotatable with respect to the plates 42.

Figure 6:
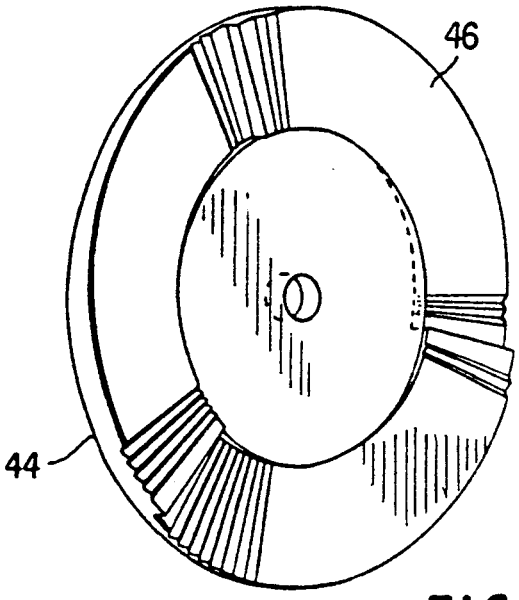
FIGS. 6, 7 and 8 are perspective views of a stop plate illustrating different ramp surfaces.

FIG. 6 shows a stop plate design in which the ramp surfaces 46 are notched or serrated on both stop plates 40 and 42 whereby the notches or serrations mesh to prevent any unwanted slippage between the plates. In order to effect an adjustment, the handle 56 and shaft 48 are depressed against the force of spring 58 to disengage the notches and permit rotation.

Figure 7:
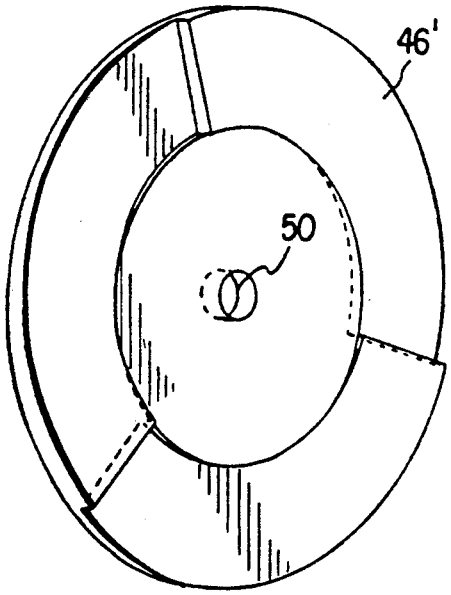
Figure 8:
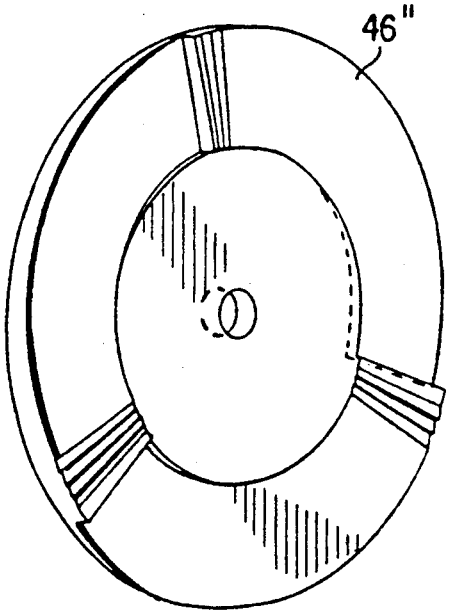

FIG. 7 illustrates another stop plate design in which the ramp surfaces 46' are smooth and FIG. 8 illustrates still another stop plate design wherein the ramp surfaces 46" have serrations on this high point.

Figure 3:
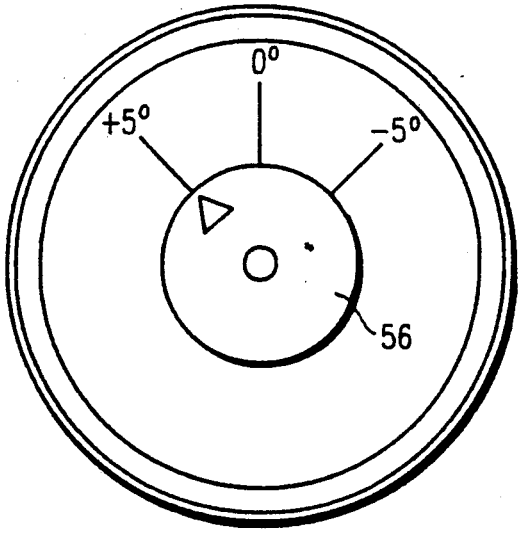
FIG. 3 is an end view of the actuator of the present invention.

FIG. 3 shows an end view of the handle 56 and illustrates how the handle and end cover may be marked to visually indicate the position of the adjustment of the stop plates.

It is to be understood that the invention is not limited to the specific constructions shown and described herein, as various modifications can be made therein within the spirit of the invention and the scope of the appended claims.

What is claimed as new and desired to be secured by Letters Patent of the United States is:

1. A fluid pressure actuator comprising:

a cylinder having an end wall, a piston assembly reciprocally movable in said cylinder, limit means proximate to said end wall for engaging said piston assembly and adjusting the stroke of said piston, said limit means including first and second stop plate means rotatable with respect to each other, and a plurality of ramps formed on the facing surfaces of each of said first and second stop plate means which cooperate to change the combined thickness of said first and second stop plate means as a function of their rotation; and means for rotating said first stop plate means with respect to said second stop plate means.

2. A fluid pressure actuator comprising:

a cylinder having an end wall, a piston assembly reciprocally movable in said cylinder, limit means proximate to said end wall for engaging said piston assembly and adjusting the stroke of said piston assembly, said limit means including first and second stop plate means rotatable with respect to each other, and means on the facing surfaces of said first and second stop plate means which cooperate to change the combined thickness of said first and second stop plate means as a function of their rotation wherein a pinion gear and rack gear are positioned within said piston assembly and said pinion gear and rack gear engage one another upon reciprocal movement of said piston assembly.

3. A fluid pressure actuator comprising:

a cylinder having an end wall, a piston assembly reciprocally movable in said cylinder, limit means proximate to said end wall for engaging said piston assembly and adjusting the stroke of said piston, said limit means including first and second stop plate means rotatable with respect to each other, and means on the facing surfaces of said first and second stop plate means which cooperate to change the combined thickness of said stop plate means as a function of their rotation wherein said limit means includes an aperture formed in a substantially central portion of said first stop plate means, a shaft passing through said aperture of said first stop plate means and being connected to said second stop plate means, and means connected to said shaft for rotating said shaft and said second stop plate means with respect to said first stop plate means.

* * * * *